United States Patent [19]

Zapp

[11] 4,009,794

[45] Mar. 1, 1977

[54] LEVER-ACTUATED CLOSURE DEVICE

[75] Inventor: Walter Zapp, Oberegg, Switzerland

[73] Assignee: I D F Company Ltd., Basel, Switzerland

[22] Filed: Apr. 26, 1976

[21] Appl. No.: 680,059

[30] Foreign Application Priority Data

May 2, 1975 Switzerland ..... 5785/75
May 2, 1975 Switzerland ..... 5787/75

[52] U.S. Cl. ..... 215/210; 215/295; 215/305; 220/262; 222/545; 215/280

[51] Int. Cl.[2] ..... B65D 81/24

[58] Field of Search ..... 215/210, 295, 305, 280; 220/260, 262; 222/545, 562

[56] References Cited

UNITED STATES PATENTS

| | | | |
|---|---|---|---|
| 3,734,330 | 5/1973 | Danner et al. | 215/210 |
| 3,809,300 | 5/1974 | Russell | 215/305 X |
| 3,844,456 | 10/1974 | Schiemann | 222/545 |

*Primary Examiner*—George T. Hall
*Attorney, Agent, or Firm*—Heinrich W. Herzfeld; Gilbert L. Wells

[57] ABSTRACT

A lever-actuated closure for bottles or the like containers is described which closure comprises a closing member sealingly mountable on an outlet orifice of the container, an actuating member having a manually operated gripper part and being hingedly mounted below the outlet orifice, and a connecting member hingedly attached to the actuating member and to the closing member at the outside thereof, which closure can be transferred, by means of the actuating member, from an open position, in which the closing member frees the outlet orifice, through elastic deformation of at least one of the parts of the closure via a dead-center position, in which the hinge axis of the actuating member and the two hinge axes of the connecting member are in a common plane, into a closed position, in which the closing member seals the outlet orifice, or vice versa from this closed position into the open position, the gripper part of the actuating member being, in the closed position, above the elastically deformed closing member and being movable sideways and downwards, relative to the closing member, for the opening of the closure.

22 Claims, 32 Drawing Figures

Fig. 7
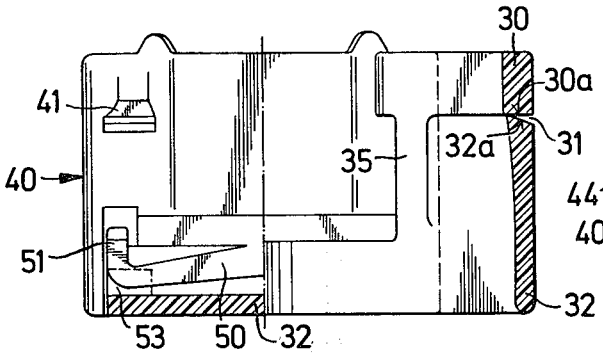
Fig. 8
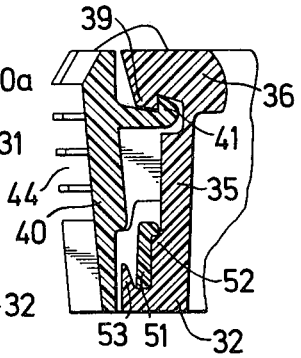
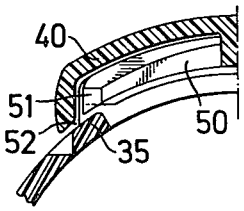
Fig. 9
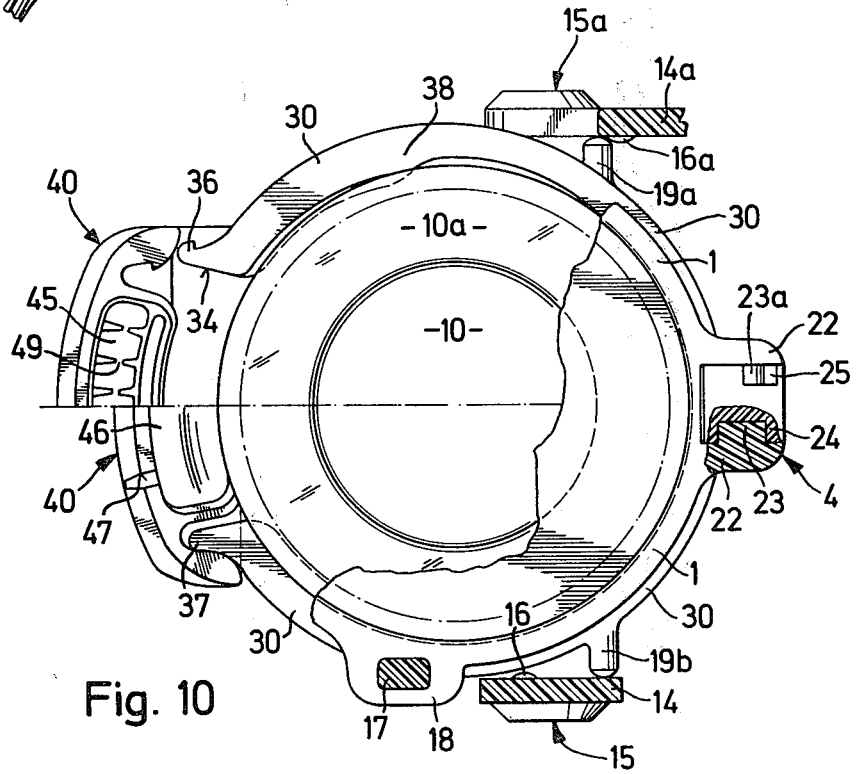
Fig. 10

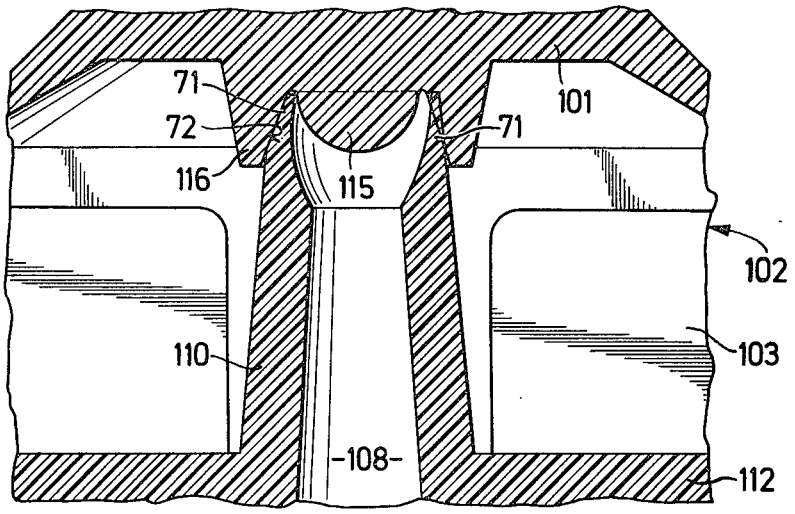
Fig. 16
Fig. 17
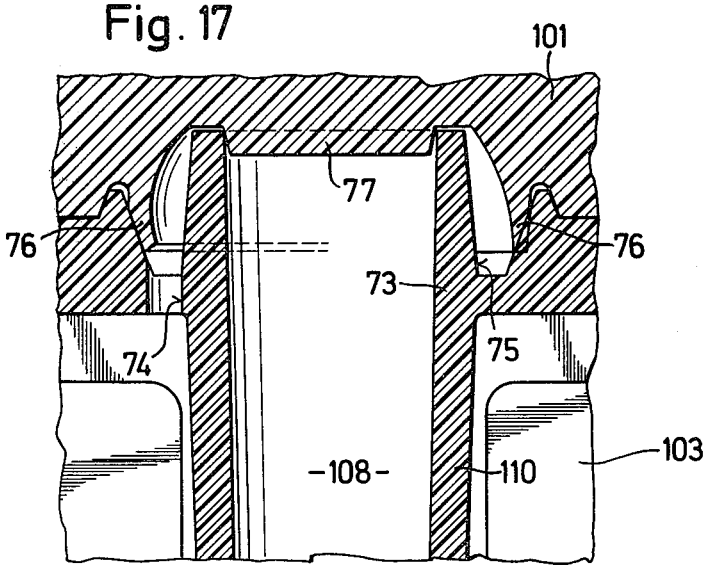

Fig. 18
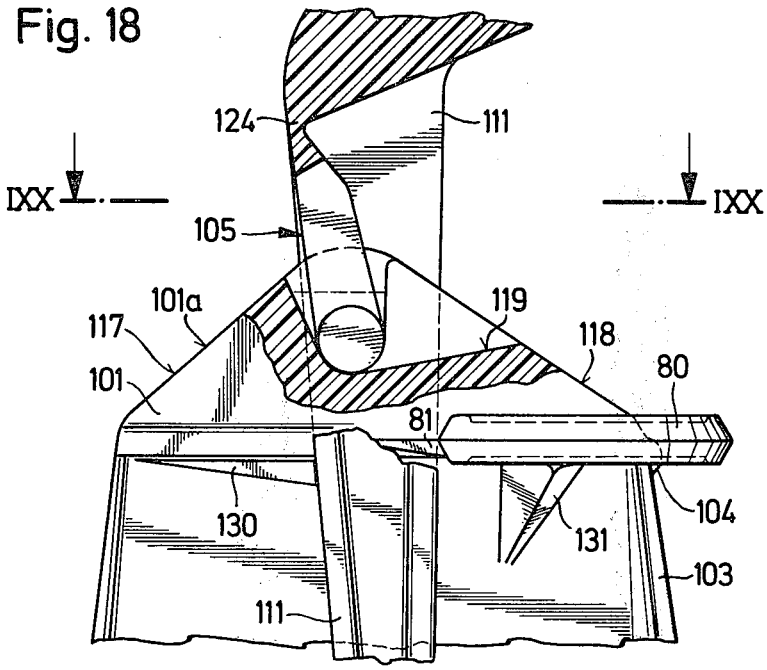
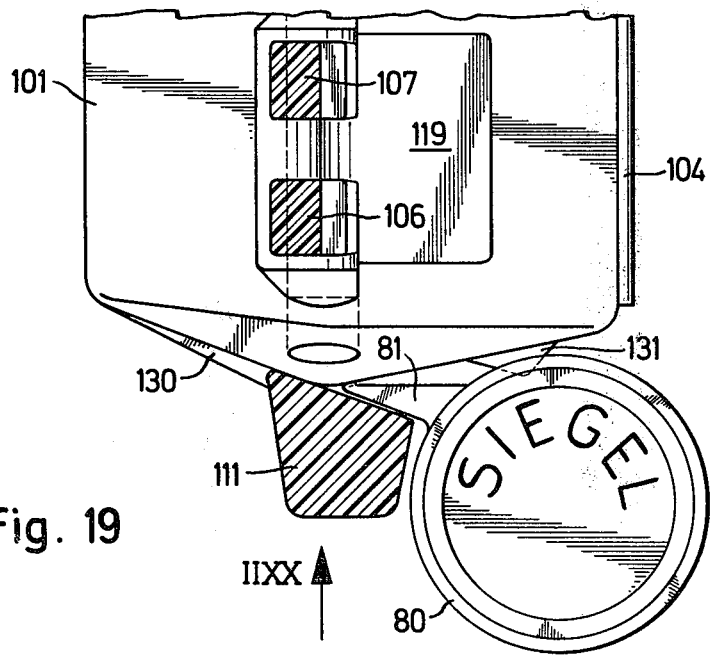
Fig. 19

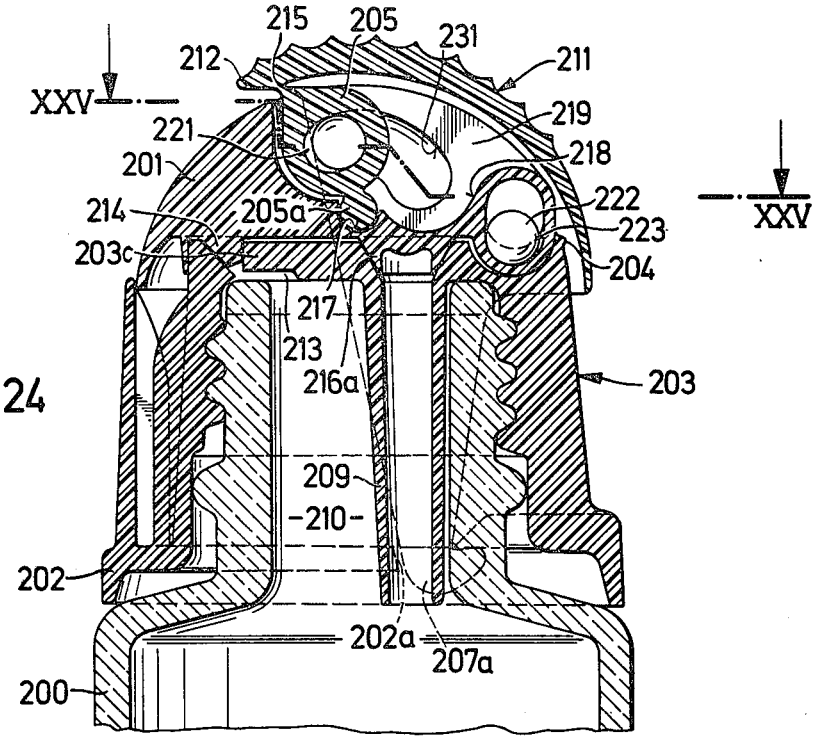
Fig. 24
Fig. 25
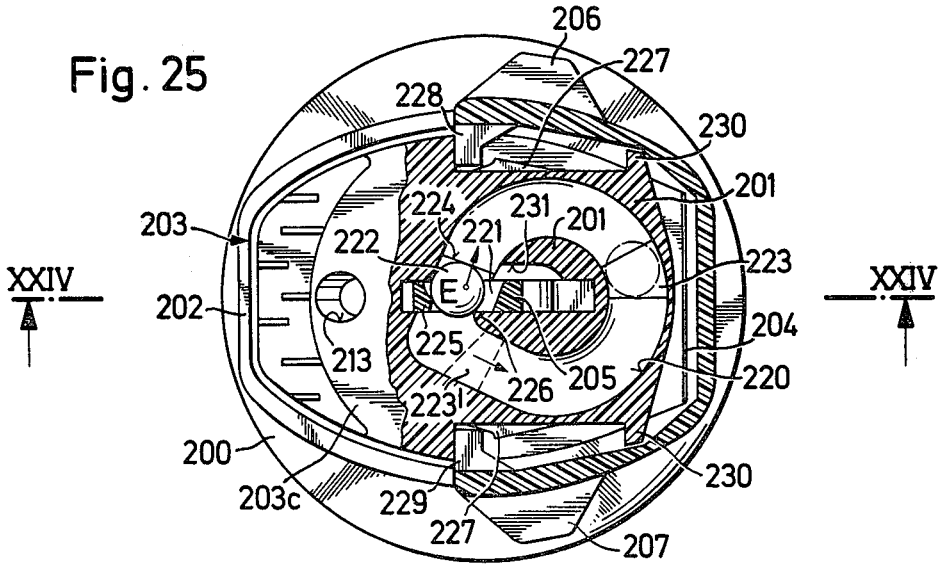

LEVER-ACTUATED CLOSURE DEVICE

The invention relates to a lever-actuated closure, especially for bottles or similar containers, with a closing member sealingly mountable on an outlet orifice, an actuating member, having a manually operable gripper part, being hingedly mounted below the outlet orifice, and a connecting member hingedly attached to the actuating member and to the outside of the closing member, which closure can be transferred, by means of the actuating member, from an open position, in which the closing member frees the outlet orifice, through elastic deformation of at least one of the said parts of the closure, via a dead-center position, in which the hinge axis of the actuating member and the two hinge axes of the connecting member are in a common plane, into a closed position, in which the closing member seals the outlet orifice, or vice versa from this closed position into the open position.

Such lever closures are well-known and have in particular been used with beer bottles and mineral water bottles made of glass. In such a closure, the closing member preferably consists of two parts, namely a non-elastic top part, for example made of porcelain, and an elastic part attached to the underside of the top part, and usually consisting of an annular rubber disc, for sealingly making contact with the rim of the bottle wall which surrounds the dispensing orifice, whilst the actuating member and connecting member consist of metal parts shaped in a known manner, the stirrup-shaped actuating member being rotatably mounted, by the ends of the stirrup, in corresponding recesses in the bottle wall.

It is true that this known bottle closure can be opened and closed with one hand, the thumb having to move the actuating member, but the force required for this is considerable. Children usually need to use both hands to open and close this bottle closure. Moreover, the automated assembly of the various parts is complicated (U.S. Pat. 634,681, Charles de Quillfeldt, of May 9, 1899).

Furthermore, this closure, because of the relatively high weight of the ceramic stopper and the necessarily loosely hinged metal construction, tends to hang in the flow of liquid when the latter is poured out of a bottle which is only half full or even less full.

Hence the trend has been to replace this conventional lever-type closure by a "crown cap", which admittedly is cheaper to manufacture and fit, but suffers from considerable disadvantages, in that it can only be removed from the bottle by means of a tool (a so-called "bottle opener") and in the course of removal becomes deformed so that hermetic reclosing of the bottle which would prevent leakage of liquid, especially with the bottle horizontal, is impossible.

The screw closures with a sealing liner, extensively used at the present time, also have disadvantages. Above all, the bottle can be opened with one hand only if the bottle is standing, and the unscrewed closure can easily be lost.

In contrast, it is the object of the invention to provide a bottle closure which, whilst retaining all the advantages of the known bottle closure described as the first one above, and also referred to as a "patent closure", can be actuated without any major exertion of force, for example by means of the index finger of the hand which grips the bottle, and which can, even with the outlet orifice of the bottle pointing downwards at a substantial angle, easily be prevented from swinging into the flow of the liquid.

This is achieved, in a bottle closure of the type described initially, by that the gripper part of the actuating member is, in the closed position, above the elastically deformed closing member, and can, for opening the closure, be moved sideways and downwards, relative to the closing member. Preferably, the connecting member is, in its dead-center position, above the outlet orifice, and a collar which can be fixed sealingly to the orifice rim of the container to be closed is provided, to which collar the actuating member is hinged, and which collar has a through-passage, the outlet mouth of which forms the outlet orifice which can be closed by the closing member.

The closing member can be mounted hingedly on the base part away from the outlet orifice. Preferably, the site of engagement of the connecting member with the actuating member is moved, in the closed position as well as in the open position, away from the position in which the two sites of engagement of the connecting member — on the one hand with the actuating member and on the other hand with the closing member — lie on a line vertical to the outer face of the closing member.

Preferably, the closing member is mounted on the container wall so as to be sluable to the side of the dispensing orifice. The site of engagement with the connecting member is advantageously, in the closed position, on the side facing away from the hinge bearing the closing member on the container wall, as viewed from the said vertical line, and can, on opening, be moved through the said position of the longitudinal axis of the connecting member coinciding with the vertical line onto the same side as the said hinge. In the closed position, the gripper part of the actuating member preferably rests, with a part thereof which carries the site of engagement with the connecting member, against the outside of the closing member.

In a particularly advantageous embodiment, the actuating member, in the lever-actuated closure according to the invention, is constructed as a tilting lever, the middle part of which is advantageously pivotally mounted on the base part via a fork-like or stirrup-like extension, and on one end of the lever are located the engagement site of the connecting member with the tilting lever and a stop for resting against the outer surface of the closing member in the closed position, whilst on pressing the opposite, free end of the lever, the tilting lever is tilted outwards and downwards relative to the outlet orifice of the container, and at the same time the connecting member, via its engagement site on the closing member, lifts the latter off the outlet orifice of the container whilst the pivoting about its hinge on the container wall.

In order to be able to apply this lever-actuated closure even to bottles which have, during storage, been closed by, for example, a non-reusable crown cap or the like, which has to be removed with a bottle opener, the closing member and the actuating member can be hingedly mounted on a carrier collar which is fixed, preferably detachably, on the part of the bottle wall which surrounds the dispensing orifice, so as to reinforce and/or act as an extension of the said part.

For disposable bottles of relatively small volume, especially squeeze bottles and dropper bottles, such as are used in large numbers for foodstuffs and medicaments, no reasonably satisfactory closures, which can be opened and closed repeatedly, are known apart from conventional stoppers, plug-in caps or screw caps. However, even stoppers and caps are not always satisfactory since, inter alia, they suffer from the disadvantage of being relatively complicated to handle. As is known, as a rule both hands are required for opening and closing such closures.

A further object of the invention is therefore to provide an improved closure which is constructionally simple, inexpensive and suitable for throw-away bottles, can be operated with one hand without significant exertion of force and nevertheless possesses adequate sealing properties.

Starting from the abovementioned embodiments, according to the invention, of such a closure, with a closing member sealingly mountable on an outlet orifice, an actuating member (or tilting lever) hingedly mounted below the outlet orifice and a connecting member hingedly attached to the closing member, which can be transferred, by means of the actuating member, from an open position, in which the closing member frees the outlet orifice, through elastic deformation of at least one of the said parts of the closure, via a dead-center position, in which the hinge axis of the actuating member and the two hinge axes of the connecting member are in a common plane, into a closed position, in which the closing member seals the outlet orifice, or vice versa from this closed position into the open position, the last-mentioned object is achieved, according to the invention, by an embodiment wherein the connecting member, in its dead-center position, is above the outlet orifice and a base part, which is sealingly attachable to the orifice rim of the container which is to be closed, is provided, onto which base part is hinged the actuating member, and which has a throughpassage, the outlet mouth of which forms the discharge orifice which can be closed by the closing member. The base part, the actuating member and the connecting member preferably consist of plastic and are integrally connected, the hinges connecting the base part to the actuating member and the latter to the connecting member being formed by flexible straps which join these parts. Furthermore it is advantageous if the closing member also consists of plastic and is integrally connected to the base part by a flexible strap which forms a hinge. This preferred embodiment provides the possibility of manufacturing a complete closure as a single injection molded part.

In preferred embodiments of the lever-actuated closure according to the invention, the side wall of the connecting member which extends between the engagement site of the connecting member on the tilting lever and the hinge of the connecting member on the closing member, and, in the closed position, faces toward the outlet side, can serve as a stop, in the closed position, the said side wall coming to rest against the outer surface of the closing member.

The side wall of the closing member which is located between the engagement site of the connecting member with the actuating member (tilting lever) and its hinge on the closing member, and faces toward the hinge member, can, in the open position, come to rest against a part of the outer surface of the closing member located on the side of the hinge member.

The outer surface of the closing member preferably has a recess, in the center of the bottom of which is provided a bearing for the connecting member, the side wall of the recess, on the discharge side, serving as a stop for the one side wall of the connecting member in the closed position, whilst the opposite side wall of this recess, namely the side wall on the side of the hinge member, serves as a stop for the other side wall of the connecting member on opening the lever closure.

The base part, the actuating member (or tilting lever) and the connecting member (or support arm) can consist of thermoplastic resin material and be integral with one another and the hinges which connect the base part to the actuating member and the latter to the connecting member can be devised as flexible straps which join these parts.

The closing member (or lid) can also consist of thermoplastic resin and be integrally joined to the base part via a flexible strap which forms a hinge.

The connecting member can have two fork arms, which are resiliently separated in the direction of its hinge axis, with bearing pegs formed at their ends and extending in the direction of the hinge axis, and these bearing pegs can be resiliently engaged in correspondingly shaped undercuts of the closing member, each undercut forming a hinge bearing.

The actuating member can be formed as a substantially U-shaped stirrup, of which the two arms are hinged onto the collar, whilst its central strap, constructed as the gripper part, has the connecting member hingedly connected thereto.

The collar can possess at least one stop for the actuating member, which stop limits the movement of the latter in the closing direction shortly after having passed the dead-center position.

Furthermore, the collar and the actuating member can be provided with mutually cooperating releasable means of engagement, especially sliding studs, which hold the actuating member in the open position.

In a particularly preferred embodiment of the lever-actuated closure according to the invention, a child-proof safety device with a coupling element in the lid and support arm is provided, which makes it impossible for the connecting member to take the lid with it until the coupling element provides a positive connection between the lid and the support arm.

The coupling element can be a ball and child-proof safety device can then furthermore have a ball race, which comprises a ball channel, running through the lid and extending from one side wall of the support arm to the opposite side wall thereof, and a window, which completes the ball race, in the support arm; holding means can be provided in and near the window, by means of which the ball can be held in the window of the support arm, in a position which locks the support arm and lid to one another.

The ball channel and the window are preferably so arranged relative to one another that, if the closure is tilted forwards over the outlet orifice, the ball runs into the locking position.

The tilting lever preferably has two fork arms, which are hinged onto opposite sides of the lid in the region between the hinge member and the outlet orifice of the collar, on the base part of the latter, and a stud pointing in the direction of the adjacent lid wall, projects from the inside of each of the fork arms.

Furthermore, on each side of the lid, in the direction of the hinge member, studs can be provided, which project in the direction of the inner walls of the fork arms, surrounding this part of the lid, of the actuating member constructed as a tilting lever, and are contacted by the studs on the fork arms when the lid and the support arm are not coupled to one another by the ball, whilst when the two said parts are coupled by means of the ball, the lid is lifted to the point that, on moving the tilting lever back further, the studs on the latter can slide beneath and past the studs of the lid.

The abovementioned holding means preferably comprise an abutment or ramp, the distance of which from the window in the support arm is less than the diameter of the ball, a nose provided in the wall of the window on the outlet orifice side and projecting into the window, and a retaining edge, projecting beyond the inner side wall of the window, in the direction of the said window, and resting against the support arm, the said edge being in the part of the lid which forms the inner wall of the ball channel.

On the parts of the wall of the lid which face the inner sides of the fork arms, studs may be provided, against which the tilting lever abuts after a short initial movement in the direction of the open position, and as a result lifts the support arm somewhat and at the same time moves the window nose in the window in such a way that it holds the ball, which as a result of the tilting of the closure into the locking position has rolled into the window, fast in the abovementioned locked position.

The outlet passage of the base part may be in the form of a squirting spout.

Furthermore, the base part can be provided with an absorbent drip catcher which surrounds the outlet orifice of the through-passage, and the closing member can be provided with a drip wiper which, in the closed position, engages round the discharge orifice.

Moreover, a tamper-proof seal may be provided, which engages in the line of movement of the movable parts of the closure so that it is broken off when the closure is opened for the first time.

Further details of the invention will emerge from the description, which follows, of preferred embodiments thereof, in conjunction with the drawing in which.

Figure 5:
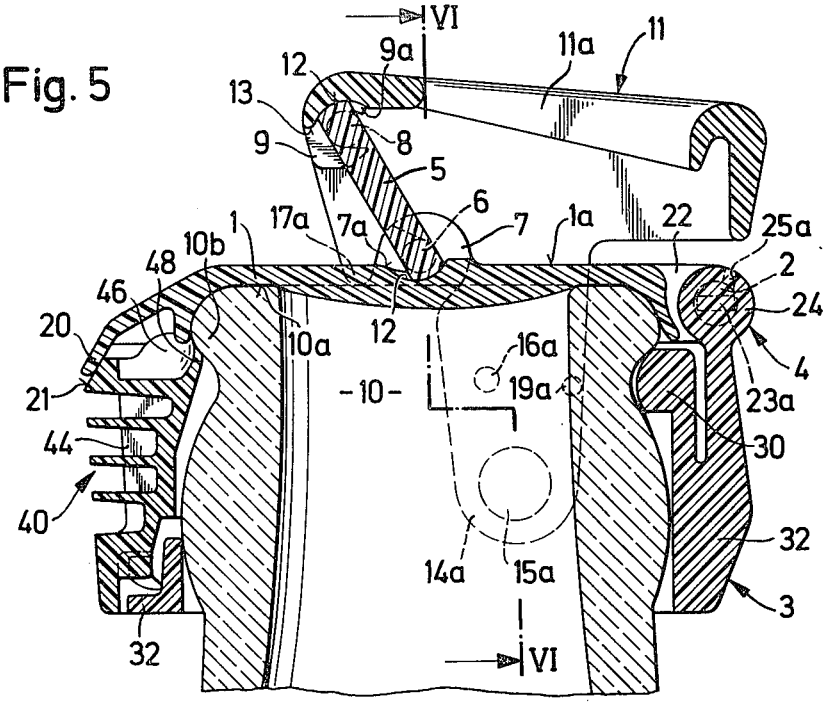
FIG. 5 shows a similar embodiment to that of FIGS. 1 to 4, in cross-section.
Figure 6:
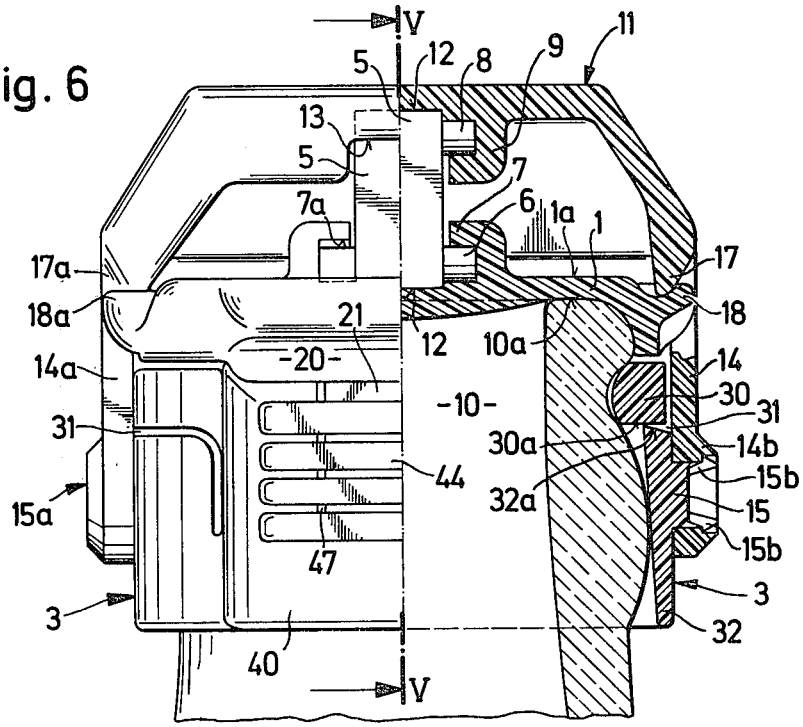
FIG. 6 shows the same embodiment, in front view, with the right-hand half shown in section in a plane corresponding to VI—VI in FIG. 5.
Figure 12:
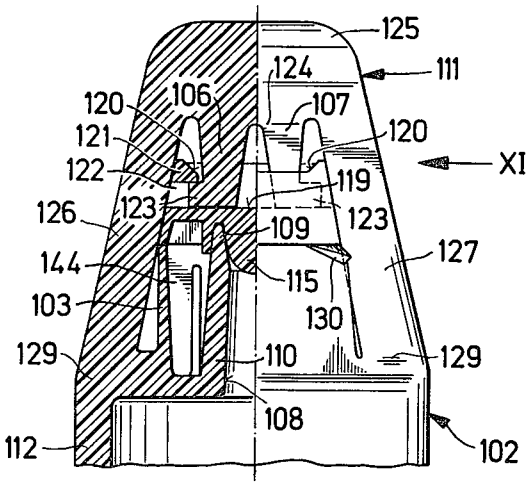
Figure 11:
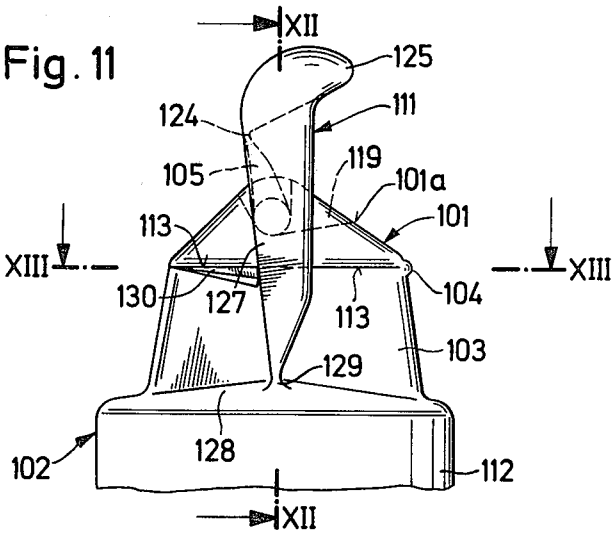
Figure 13:
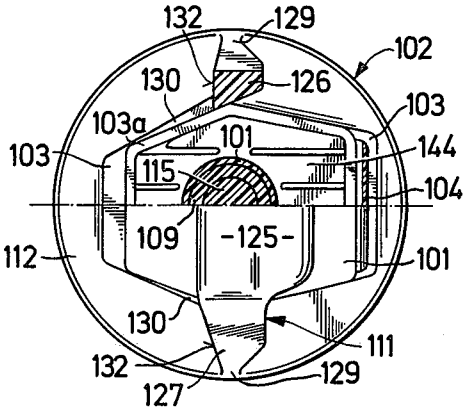
Figure 14:
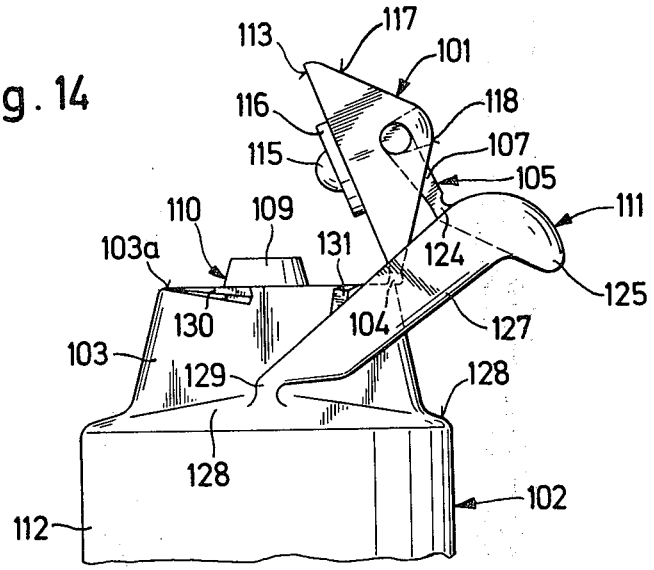
Figure 15:
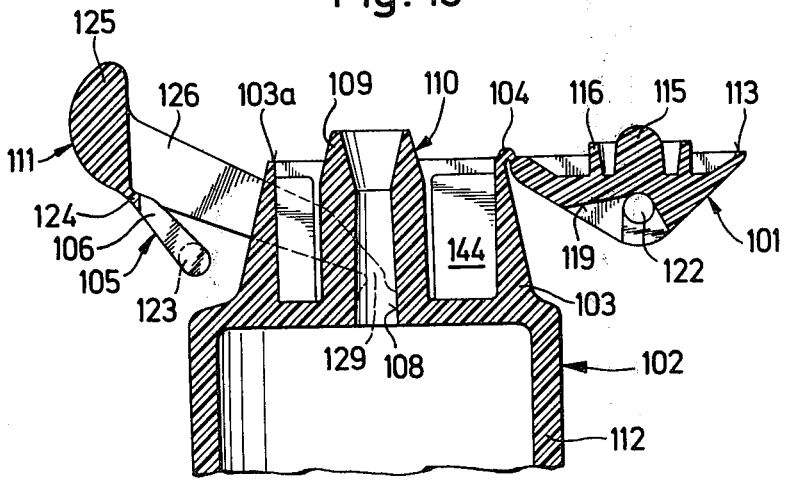
Figure 20:
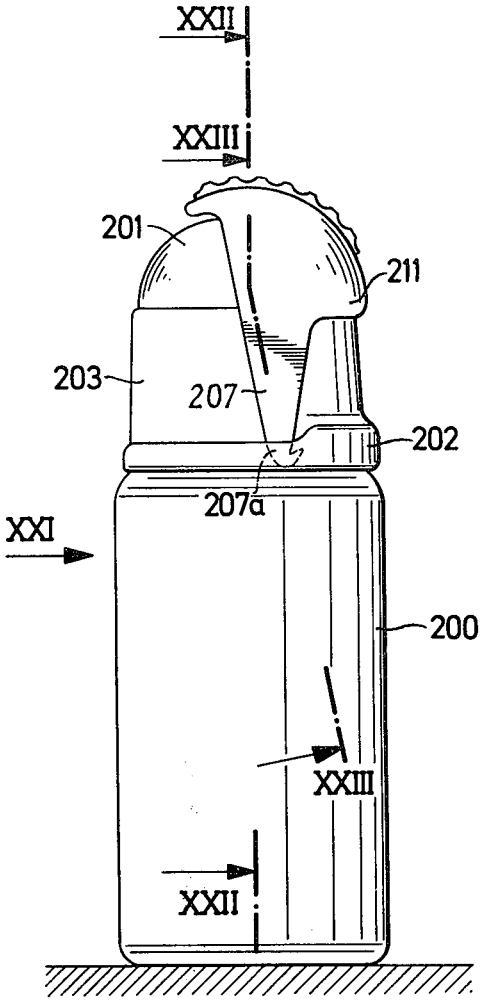
Figure 21:
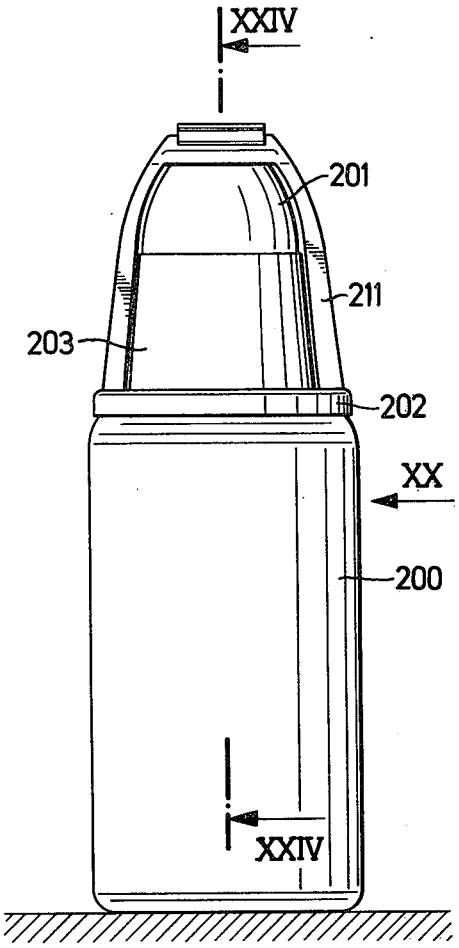
Figures 22, 23:
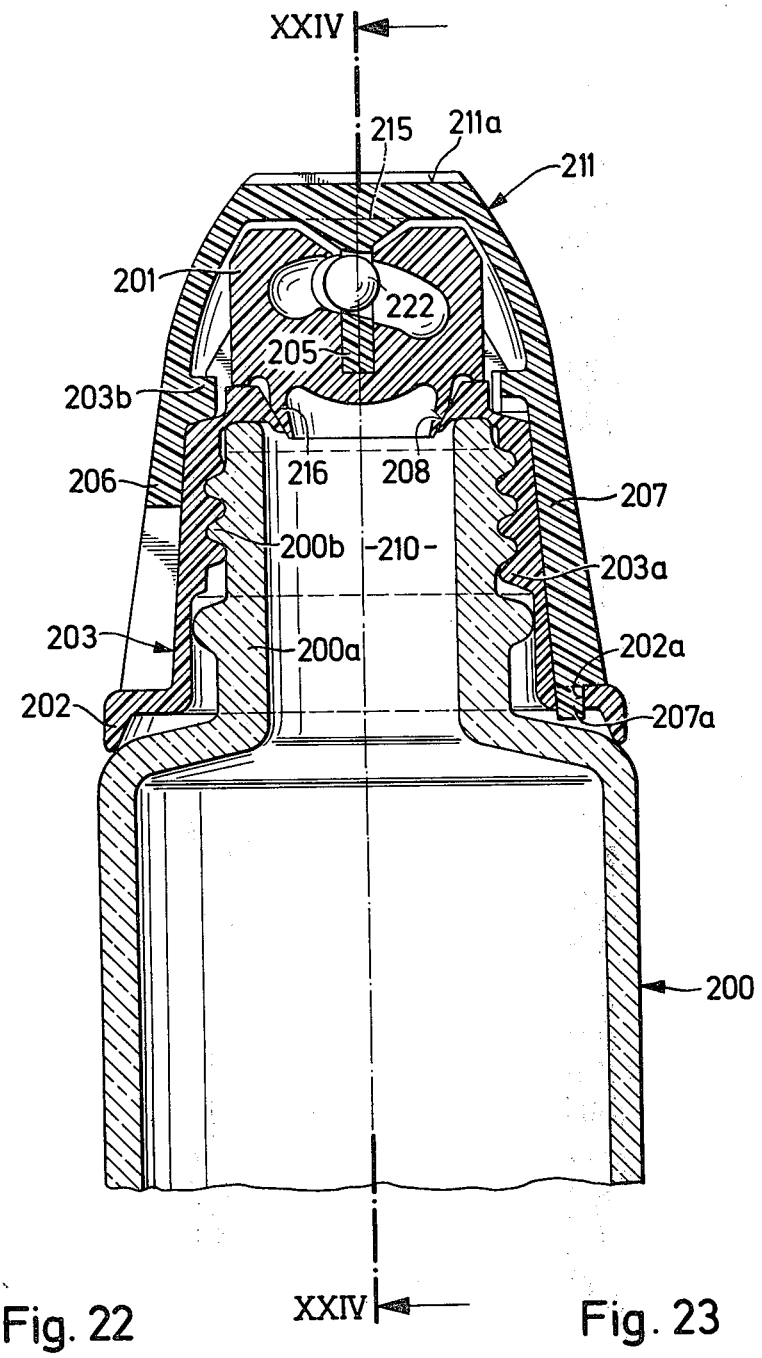
Figure 26:
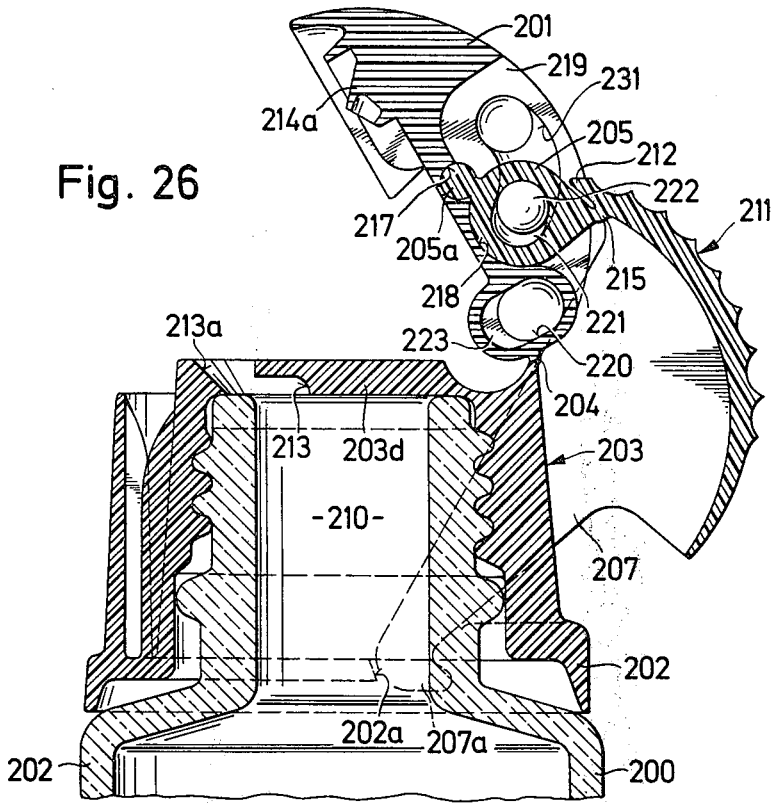
Figure 27:
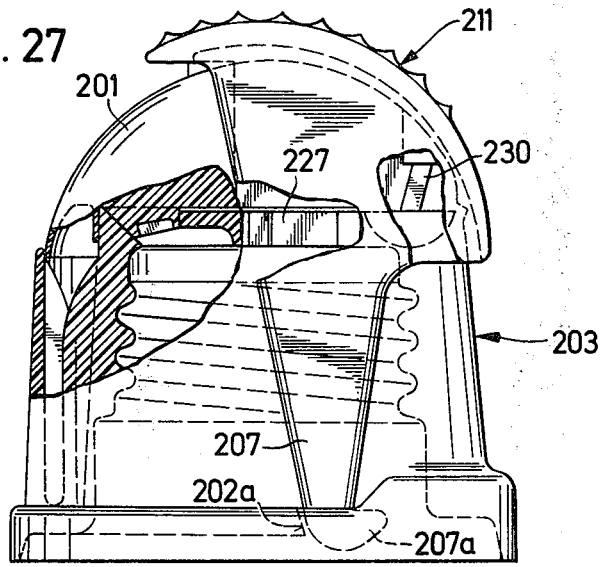
Figure 28:
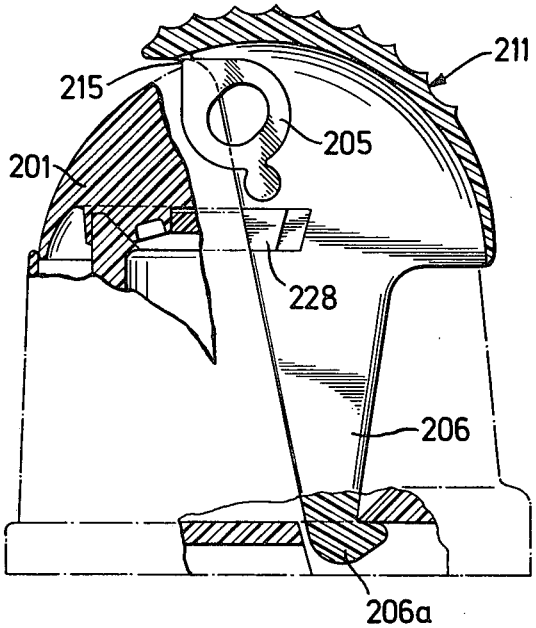
Figure 29:
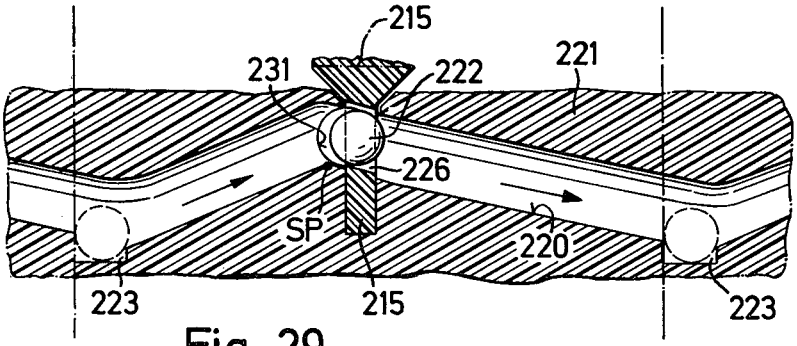
Figure 30C:
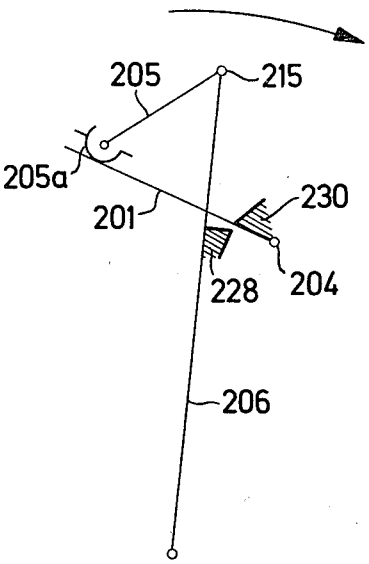
Figure 30B:
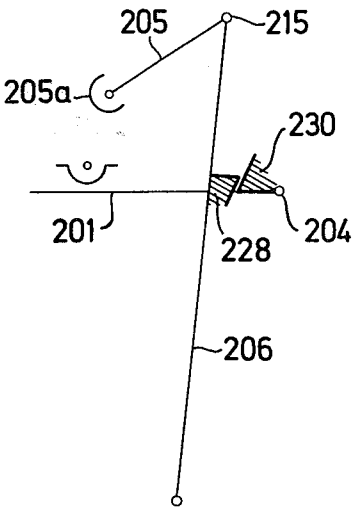
Figure 30A:
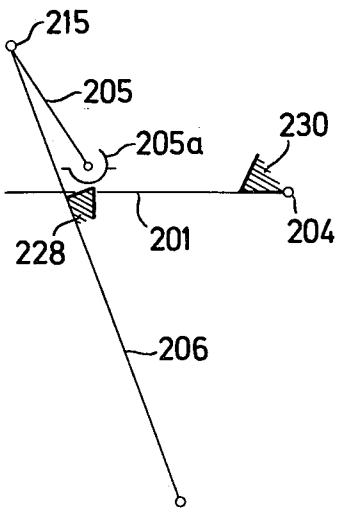

FIGS. 7, 8, and 9 show details of the embodiment according to FIGS. 5 and 6;

FIG. 10 shows a plan view, partially in section, of the same embodiment;

FIG. 11 shows a further embodiment of the bottle closure according to the invention, in side view;

FIG. 12 shows a front view of the same embodiment as in FIG. 11, half being shown in section along plane XII—XII in FIG. 11;

FIG. 13 shows a plan view, partially in section along plane XIII—XIII in FIG. 11, of a closure according to the invention, in the closed position;

FIG. 14 shows a side view of the opened closure according to FIG. 11;

FIG. 15 shows a longitudinal section through the same closure as in FIG. 11, but folded open, immediately after release from an injection mold;

FIGS. 16 and 17 show detail variants of the embodiment according to FIGS. 11 – 15, in longitudinal section;

FIGS. 18 and 19 respectively show a side view and plan view, both partially in section, of a closure according to the invention, in the embodiment according to FIGS. 11 – 15, provided with a tamperproof seal;

FIG. 20 shows a side view of a further embodiment of the closure according to the invention, provided with a child-proof safety device and fitted, in the closed position, onto a bottle;

FIG. 21 shows a front view of the same embodiment as in FIG. 20;

FIG. 22 shows a longitudinal section through the closure represented in FIG. 21, along the plane marked XXII—XXII in FIG. 20;

FIG. 23 shows a longitudinal section similar to that in FIG. 22, but along the plane marked XXIII—XXIII in FIG. 20;

FIG. 24 shows a longitudinal section through the embodiment of FIGS. 22 and 23, but along a plane marked XXIV—XXIV in FIGS. 21 and 22, and in the closed position;

FIG. 25 shows a cross-section along the planes marked by the broken line XXV—XXV in FIGS. 22, 23, and 24;

FIG. 26 shows the same section as FIG. 24, but in opened position;

FIG. 27 shows the same closure in the same position as FIG. 24, but in side view and in partial section;

FIG. 28 shows the same closure as in FIGS. 24 and 27, but in section so as to reveal the inside of one fork arm of the actuating member;

FIG. 29 shows the unwound ball race of the child-proof device in the closing member of the embodiment of FIGS. 21 – 28; and FIGS. 30*a*, *b* and *c* show three positions of the interaction of the studs in a fork arm of the actuating member and the opposite outer face of the closing member, in the last-mentioned embodiment of the closure.

In detail, the embodiments according to FIGS. 1 to 6 comprise a lid 1 constructed as a sealing member and consisting of a material which is elastically somewhat deformable, at least in the region of the discharge orifice 10, which lid is mounted in a bearing 4 of the collar 3 by means of a peg 2. On the outer side 1*a* of lid 1, the support arm 5 which serves as the connecting member is, on the one hand, in pivotal engagement, by means of the peg 6 provided on the arm end which is turned toward the interior of the bottle, with the bearing 7 provided on the lid 1, whilst a peg 8 provided at the other end of the support arm 5 is in pivotal engagement with a bearing 9 which is provided in the vicinity of the front end of a tilting lever 11, serving as the actuating member, as a bearing socket 12 on the inner side of the said lever. The tilting lever 11 has two fork arms 14 and 14*a* which extend on opposite sides over the wall of the collar 3 and are hinged on pegs 15 and 15*a* in the outer wall of the said collar. The front beveled free end 20 of the lid 1 rests on a correspondingly beveled contact surface 21 of the collar 3 and is pressed, against the upper front rim 10*a* of the bottle orifice 10, in a manner which will be explained later, by the tilting lever 11, the pivotal movement of which about the pegs 15 and 15*a* in a forward direction, i.e. away from the bearing 4 of the lid 1, is limited by the noses 17, 17*a* making contact with the stops 18, 18*a* provided on the outer wall 1*a* of the lid 1.

Figure 1:
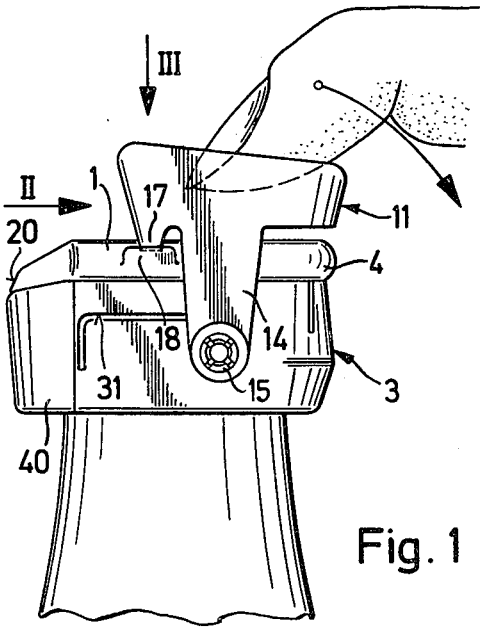
FIG. 1 shows a first embodiment of the bottle closure according to the invention, in the closed position, mounted on the neck of a bottle, and in side view.
Figure 2:
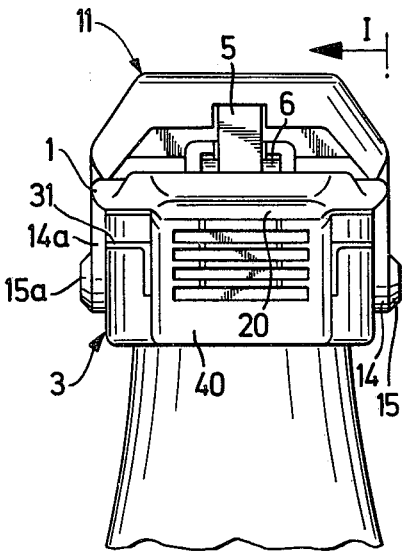
FIG. 2 shows the same closure as in FIG. 1, but in front view, that is to say seen from the left of FIG. 1.
Figure 3:
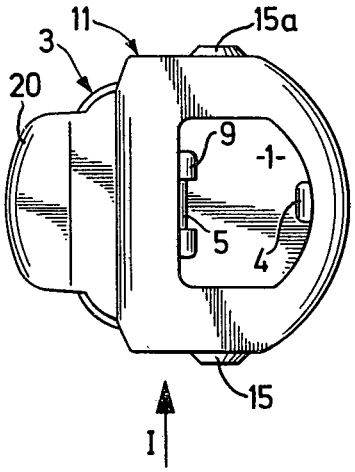
FIG. 3 shows the same closure as in FIGS. 1 and 2 in plan view.
Figure 4:
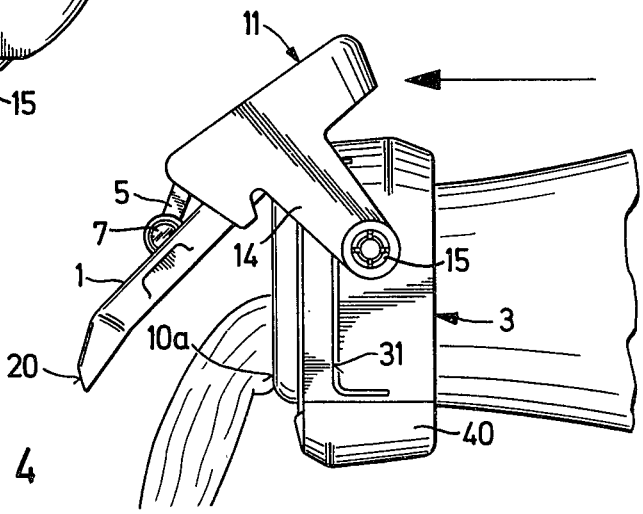
FIG. 4 shows the same closure, but in the opened position, in side view.

The closure which in FIGS. 1 to 6 is substantially identical in respect of its movable parts is opened by bringing the tilting lever 11 from the closed position shown in FIG. 1 into the open position shown in FIG. 4, for example by means of the index finger (FIG. 1), the tilting movement being backwards and downwards in respect of the axis of the bottle orifice and the bearing 4 of the lid 1, through an angle of about 50°, until the lid 1 is stopped by its upper side coming into contact with the inner upper rim of a recess 13 in the front face of the tilting lever 11. In this end position, the lid 1 is open at an angle of 45° by appropriate design of the recess 13 of the tilting lever 11, but should preferably permit unhampered pouring-out of the contents of the bottle.

In the pressed-down position shown in FIGS. 1 and 5, the lid 1, which is somewhat deformed inwardly, exerts a pressure, by virtue of its elasticity, via the support art 5 and its pegs 6 and 8 against the front part of the tilting lever 11 at 12. This presses the front part of the lid 1, in the direction of its front face 20, sealingly against the rim 10*a* of the bottle orifice 10. Under these conditions the tilting lever 11 cannot give way, since this would require tilting the support arm 5 about the peg 6 into a position at right angles to the outer face 1*a* of the lid, in which position the peg 8 of the support arm 5 would come to be exactly above the peg 6, which however would increase the distance between the inner face of the tilting lever 11 and the outer face 1*a* of the lid and in doing so would cause maximum deformation of the middle zone of the lid 1. Hence, in the closed position, the tilting lever 11 endeavors to keep the lid 1, as far as possible, in the position shown in FIGS. 1 and 4, as a result of which, in the case of FIG. 4, the bottle orifice 10 remains hermetically closed.

Since all movable parts can be manufactured from a lightweight thermoplastic material, there is no danger of the lid and tilting lever falling back into the closed position even when the bottle orifice is inclined downwards at an angle of 45°, since all movable parts can be fitted together under sufficient friction so that, whilst opening is effected easily, the friction of the support arm 5 and its pegs 6 and 8 in the bearings 7 and 9 and the friction of the fork arms 14 and 14*a* against the outer wall of the collar 3 suffice alone to prevent the closure from falling shut. Furthermore, the collar 3 can carry friction studs 19, 19*a* on its outer wall, which have a braking action on the fork arms 14, 14*a* and prevent the lid 1 from unintentionally falling shut. It is also possible additionally to provide, on the inside of the fork arms 14, 14*a*, guide studs 16, 16*a* which, in the maximally-open position as shown in the upper half of FIG. 10, engage behind the friction studs 19, 19*a*, in the opened position of the tilting lever 11 and hence of the lid 1, and thus prevent the closure from falling shut. The engagement and disengagement of the guide studs 16, 16*a* requires only a slight additional pressure applied by the finger on the tilting lever 11.

To facilitate assembly, it is possible for the holder parts of bearings 7 and 9 only to surround the pegs 6 and 8 partially, leaving slits for laterally sliding in the pegs at 7*a* and 9*a* (FIG. 5). Naturally, the direction of the slits 7*a* 9*a* must differ adequately from all of the working positions of the support arm 5. The lid 1 can also be inserted in a similar manner by its pivot peg 12 in the holder of bearing 4 of the collar 3.

In the embodiment according to FIG. 10, the lid 1 possesses a rear fork member 22 which carries, on the inner walls of the fork arms, flattened pivot pegs 23, 23*a* which are inserted in two corresponding recesses 25 in a holder projection 24 of the collar 3. Preferably, the flattened pivot pegs 23, 23*a* are pushed into the recesses 25 through slits 25*a* (indicated in FIG. 5), for which purpose the lid 1 must be tilted backwards through about 120° from its closed position. Since in use, the lid is only tilted back by a maximum of about 45°, there is no danger of the pivot pegs 23, 23*a* becoming disengaged from their bearings. These bearings 25 should be so dimensioned as to compensate for small tolerances in the dimensions of the closure and so as to leave a slight rearwardly directed spring force, because of which the lid sealingly surrounds the pouring edge at the bottle rim at 10*a* even if the dimensions of the said edge should perhaps be too small. This ensures that at this critical position remnants of liquid are reliably removed so that no hygienically undesirable decomposition of such remnants may take place there.

The pivot joints of the fork arms 14 and 14*a* of the tilting lever 11 are brought into engagement on the pegs 15, 15*a* of the collar 3, which preferably, as shown in FIG. 6, consist of hollow studs. The hollow studs can comprise outwardly conically tapering stepped flanges 15*b* which can engage with corresponding shoulders 14*b* in the fork arms 14, 14*a*. This type of connection cannot be disengaged and is therefore only made after assembling the lid and the support arm with the tilting lever and the collar.

In the embodiments of FIGS. 5 to 10, the collar 3 is constructed, to facilitate its fixing on the bottle neck and removal from the said neck, so that its lower part consists of a continuous ring, the internal diameter of which corresponds to the normal, lower broad bead on a conventional bottle neck. The upper rim of the collar 3, however, consists of a split part-ring member acting as a clamping ring which has an annular bead on the inside and which fits into the constriction on the bottle neck in which a crown cap which has already been removed may previously have been engaged. This clamping ring 30 is separated from the lower ring portion 32 at all but one side by a horizontal wedge-shaped slit 31 (FIGS. 6 and 7) and is only joined to the continuous lower ring portion 32 of the collar on the side of the bearing 4 for the lid. The front end of the collar 3 is formed only by the continuous ring portion 32, whilst the zone above the said front end corresponds to the slit 34 of the clamping ring 30. A drip catcher 40 is fitted into this slit. On either side of drip catcher 40, the wedge-shaped slit 31 continues vertically downwards, as does the tensioning rim of the clamping ring 30, in the form of narrow straps 35 (FIG. 9). When mounted in position the tensioning rim of the clamping ring 30 is gripped, at forwardly projecting noses 36, 37, by the drip catcher 40 which engages round them and, in the upper half of FIG. 10, is shown before being snapped into position. Thus, when the drip catcher 40 has snapped into position, the clamping ring 30 is pressed around the bottle neck. This tensioning is applied preferably at three points of engagement set at intervals of 120°, below the upper bottle neck bead 10*b*, the three points being behind the lid hinge 4 and at two further points on opposite sides. This results in uniform distribution of the holding force and in advantageous conditions for attaching and removing the closure. The closure is removed, after releasing the drip catcher, by tilting the collar 3 backwards until the rear clamping bead of the clamping ring 30 disengages from the constriction in the bottle neck. In the released state, the clamping ring 30 should open up sufficiently so that its clamping noses can still be seized by the drip catcher 40 which serves to close them together, but the lateral clamping beads are already sufficiently remote from the trough of the constriction (of the bottle neck) that during the subsequent upward movement they can easily be forced sideways off the upper bottle rim. For easy clamping and splaying it is advantageous if the zone 38 of the clamping ring 30 which is between the clamping beads is thinner than the remainder of the ring (FIG. 10). Furthermore, this ensures better adaptability in the case of inaccurate dimensions.

The vertical connecting straps 35 (FIG. 9) between the clamping ring 30 and the lower part 32 of the collar prevent the clamping ring 30 from being deflected upwards, when the whole collar is seated on the bottle neck; such deflection may otherwise occur due to the slight upward tension as the lateral clamping beads are pressed aside by the bottle rim. Conversely, on closing the lid 1, the clamping ring 30 is subjected to an upward force in that the pivot pegs 15, 15*a* now lift the lower part 32 of the collar 3 against the clamping rim against which they are destined to find their hold. This means that if the dividing slit had the same minimum width throughout, the front part of the collar 3, carrying the drip catcher, would lift by this amount because the weak straps 35 would not be able to offer sufficient resistance. However, even the wedge-shaped slit 31 would still be inadequate if the edge 32*a* of the wedge were to face an edge of the bottle, because it would tend to avoid the latter and slide past it. A reliable support is only provided due to the fact that the edge 32*a* at the lower rim of the collar, at the clamping rim above the edge, is opposite a horizontal surface 30*a* which extends beyond the said edge 32*a* (FIGS. 6 and 7).

After the drip catcher 40 has fulfilled its clamping function by being pushed horizontally onto the collar 3, it is secured, in turn, in this position because the clamping rim noses 36, 37 are provided, on their underside, with hooks (FIG. 8) which engage with hook-in recesses 41 on the drip catcher, the latter giving way resiliently downwards on closing. To ensure reliable seating of the closure on the bottle neck, it is necessary that the clamping pressure and hence the friction are not so great that the upward-directed spring force of the drip catcher 40 is insufficient to overcome this friction reliably. Where there is a danger of this being the case, the engagement can also be effected by means of lateral hooks and hook-in recesses on the clamping ring 30 and drip catcher 40 respectively, provided these only occupy an upper part of the clamping rim noses 36, 37, which is smaller than the resilient deflection of the drip catcher (FIG. 10). The downwardly-directed bias of the latter is then only utilized for opening, because the inherent elasticity of the parts suffices for engagement during closing.

The drip catcher is carried, and at the same time sprung in two directions, by its lower end in the ring part 32 of the collar. From the center of its lower face there extends, integrally molded on both sides, a rod-shaped spring 50 (FIGS. 7 and 9) with double-hook ends 51 (FIGS. 7, 8, and 9). This slightly downward-pointing spring 50 is tensioned when depressing and thereby opening the drip catcher 40 and thereby also brings about the engagement by hooks 39 and 41, where a vertical hooking arrangement is used (FIG. 8). The spring 50 rests, by the short end hook 51, against the collar rim at 52 (FIG. 8). The fact that the points of contact are brought to a higher position by the intermediate chamfer, firstly prevents the static friction which would otherwise be produced at the bottom of the lid on depression, there being instead a rolling friction at the point of contact, resulting in resilient deformation in the region of the hook, and secondly the spring 50 thereby achieves a grip in the direction of a twisting stress which tilts the drip catcher 40 outwards, in that the upper ends of the hooks press against the rim of the collar 3, that is to say inwards, whilst at the bottom the hook elbows rest outwardly against the studs 53 at the base of the collar 3 (FIGS. 7, 8, and 9). These support studs 53 must be rounded off upwardly and outwardly so as slightly to bias the spring, during assembly, counter to its tension. This minimum bias is also necessary in order to protect the drip catcher 40, in the opened state, from dropping out. The outward torque firstly serves to retain this position during assembly and dismantling, so as not to interfere with the opening of the clamping ring 30, and also so as to achieve an automatic outward tilt, and hence opening, after depression, and therefore, disengagement of the hooks.

By providing a drip catcher, the customary porous absorbent materials can be dispensed with, for the sake of simplification and standardization, and instead the plastic body itself is provided with capillary suction chambers. These suction chambers 44 can be arranged either on the outside, in which case they are preferably horizontally superposed on one another (FIGS. 5, 6, and 8), or they can be provided as inner suction chambers 45, in which case they are more advantageously arranged vertically alongside one another (FIG. 10).

The external chamber type appears advantageous where liquids are concerned which contain little or no solids, since this type of chamber ensures rapid drying out and hence unlimited or substantial absorption capacity even when used repeatedly over long periods; alternatively, the external chamber type appears appropriate if copious residues demand frequent but simple cleaning, since the drip catcher can easily be detached from its seat, in order to be cleaned, and can then be reinstated. In that case, the outwardly open chambers permit easy cleaning with a brush.

Those droplets which run down close to the bottle rim are first collected in a hollow 46 (FIGS. 5 and 10), from where the excess runs through the notches 47 (FIGS. 6 and 10) into the outer chambers 44. To prevent the droplets from running through between the collar and the bottle and hence also running into the mechanical parts of the closure, the latter sealed under the bottle rim by a thinly tapering and therefore soft and elastic sealing lip 48, which easily undergoes deformation on closing the drip catcher (FIG. 5).

The internal chambers 45 are to be preferred if very high standards, also in respect of external cleanliness, are required; this is particularly true in the case of beverages, where external residues would attract insects. Since the internal chambers, which are only open at the top, are hardly amenable to mechanical cleaning, it is, in this case, advisable, when dealing with liquids which leave a copious residue, and when using the closure repeatedly, simply to exchange the one-part and thus very inexpensive drip catcher. Vertical tubes arranged individually would of course tend to form air locks; to prevent this, the tubes are laterally interconnected by narrow gaps 49 (FIG. 10), so that as liquid begins to enter from above — and this of course never occurs simultaneously for all the chambers — the air, and thereafter the liquid, can escape into the adjoining chambers.

The two types of drip catcher are mutually interchangeable. The lid 1 extends forward over the drip catcher 40 (FIG. 5). This protects the latter against unintentional depression and possible disengagement or opening. Furthermore, in the internal chamber type, the liquid residues are completely enclosed as a result of the lid extending forward.

As may be seen especially from FIGS. 11, 14, and 15, the particularly robust embodiment of the closure shown in FIGS. 11 to 19 essentially only comprises four constituents, namely a base part 102 with a collar part 103 (corresponding to the collar 3 in the preceding embodiments), an actuating member 111, hinged to the wall of the said base part and having a gripper part 125, a connecting member 105 hinged thereto and, finally, a closing member 101 articulated onto the connecting member and hinged onto the base part.

The base part 102 comprises a cap-shaped lower part 112, downwardly open, by which part 112 it may be sealingly attached, in a manner which is in itself known, to the orifice rim of the container which is to be closed — for example a deformable plastic bottle or a small medicine bottle. For this purpose the lower part 112 may, for example, also be provided with an inner thread which can then be brought into engagement with a corresponding thread on the orifice rim of the container.

On the side of the lower part which faces away from the container which is to be closed, there is an outlet nozzle 110 coaxial with the lower part and, for example, in the form of a squirter spout, said nozzle forming a discharge channel 108 for the liquid to be dispensed from the container. The mouth portion 109 of the outlet nozzle 110 is constructed as a seat for a stopper 115 located on the closing member 101. The outlet nozzle 110 is surrounded by a collar part 103, upwardly open, which is concentric with the nozzle and is approximately hexagonal in cross-section. In the interspace between the collar part 103 and the outlet nozzle 110, a system of pockets 144 inter-connected by capillaries is provided, which pockets absorb any liquid remnants which may adhere to the outside of the outlet nozzle 110 or run down the latter, and thus form a drip catcher.

With the closure in the closed state, the lower outer rim 113 of the closing member 101 sits flush on the upper end face 103*a* of the collar part 103. Along one edge of its outer rim 113, the closing member is hingedly connected, by a thin, elastically deformable strap 104, to the collar part 103. The thickness and elasticity of this hinge strap 104 is so chosen that the closing member 101 may, without damage to the strap 104, be swung from the position shown in FIG. 11.

On the underside of the closing member 101 there is provided, in addition to the stopper 115, a sleve 116 which concentrically surrounds the stopper and which externally surrounds the orifice part 109 of the outlet nozzle 110 when the closure is in the closed state (FIG. 12). This not only results in an improved sealing action, but also serves to strip off, each time the closure is closed, any liquid remnants which may adhere to the mouth 109 and may possibly dry out, so that when liquid is next dispensed, these remnants are not flushed with it.

The upper face 101*a* of the closing member 101 is roof-shaped, with two chamfered faces 117 and 118 parallel to its hinge axis, and is provided with an upwardly open recess 119, which on the inside, behind two projections 121 provided with chamfered faces 120, widens out on either side, in each case to form an approximately cylindrical bearing bush 122 whereof the axis is parallel to the hinge axis of the closing member 101 (FIG. 12). A pivot peg 123, molded onto each of the two fork arms 106 and 107 which form the connecting member 105, is rotatably fitted into each of these bearing bushes 122. The projections 121 prevent the pivot pegs 123 from slipping out of the bearing bushes 122. The two fork arms 106 and 107 are splayed in the region of the hinge axis of the closing member 101, but are elastically compressible towards one another to a sufficient degree to make it possible to snap the pivot pegs 123 from above, through the recess 119 along the chamfered faces 120 of the projections 121, into the bearing bushes 122. The two fork arms 106 and 107 of the connecting member 105 join up at their ends remote from the pivot pegs 123 and are there conjointly hingedly connected, by means of a thin elastic hinge strap 124, to the underside of the middle strap 125 of the approximately U-shaped actuating member 111 (FIGS. 11 and 12).

The middle strap 125 of the actuating member 111 is constructed as a gripper part. The two side-arms 126 and 127 of the actuating member 111 extend over the closing member 101 and the collar part 103 of the base part 102 and are hingedly connected to a shoulder 128, which forms the transition between the collar part 103 and the lower part 102*a* of the base part 102, the connection comprising, in each case, a thin elastic deformable hinge strap 129, the hinge axis being parallel to that of the closing member 101. Thus the base part 102, the actuating member 111, the connecting member 105, and the closing member 101, which all consist of plastic, preferably of a thermoplastic, are integrally joined to one another.

Engagement studs 130 are formed on the outside of the collar part 103, on the side remote from the hinge strap 14, and these studs serve as stops for the actuating member 111 and limit its tilting movement in the direction away from the hinge strap 104 (FIG 13). Similarly, slid studs 131 are provided on the side of the collar which faces the hinge strap 104; these cooperate with appropriately shaped stud faces, which are not shown, on the inside of the arms 126 and 127 of the actuating member 111 and hold the latter, in an easily releasable meanner, in the open position shown in FIG. 14.

As already mentioned, all parts of the closure described above consist of plastic and can, because of being constructed in accordance with the invention, be manufactured particularly simple as a one-piece injection molding. FIG. 15 shows the closure in the state in which it leaves the injection molding machine. As may be seen, in this flapped-open position of the individual movable parts of the closure there are no undercuts with the exception of the two bearing bushes 122, so that the production of the injection mold does not present any particular difficulties.

To assemble the closure, the closing member 101 is now first flapped over into the position shown in FIG.

11. The actuating member 111 is then tilted upwards, whereupon the pivot pegs 123 of the connecting member 105 slide upwards along the chamfered face 117 of the closing member 101 and finally drop into the recess 119. By further tilting the actuating member 111 into the position shown in FIG. 11, the pivot pegs 123 slide along the chamfered faces 120 of the projections 121 into the bearing bushes 122 and finally resiliently engage therein. At the same time the rear edges 132 of the two arms 126 and 127 of the actuating member 111 engage at the catch studs 130 so that the actuating member 111 can no longer move back into its starting position, shown in FIG. 14.

The actuating member 111 and the connecting member 105 form a type of toggle. Their sizes are such that in the position of the actuating member 111 shown in FIG. 11, the closing member 101 is pressed, under some pressure, onto the outlet orifice of the mouth part 109. The contact pressure is produced by elastic deformations of the individual parts made of plastic, especially of the hinge straps 124 and 129.

To open the closure, the actuating member 111 is tilted in the direction of the hinge axis of the closing member 101. In the course of this movement, it passes through a dead-center position, in which the hinge axes of the hinges formed by the hinge straps 129 and 124, the bearing bushes 122 and pivot pegs 123 are in one plane, and in which the elastic deformation of the individual parts of the closure is at a maximum. As soon as this dead-center position has been passed, the actuating member 111 can be tilted almost automatically into the position shown in FIG. 14 and at the same time it lifts the closing member 101 off the discharge orifice of the mouth part 109. In this position, the actuating member 111 engages resiliently with the slide studs 131 and is thus held lightly in the open position. As a result, the closing member 101 can never get in the way of the issuing jet of liquid. Of course, the slide studs 131 can also be omitted. A similar effect can, for example, also be achieved by suitably adjusting the mutual friction of the individual movable parts. Furthermore, it is of course also possible to provide stops (which are not shown) which limit the tilting movement of the actuating member 111. As a result of the stress which exists in the hinge straps 124 and 129 in the open position of the actuating member 111, the latter endeavors to spring back into the closed position and hence to initiate the closing process.

To close the closure, the actuating member 111 is tilted back, from the position shown in FIG. 14, through the dead-center position into the starting position according to FIG. 11.

The embodiment of the closure described above can very easily be operated merely with one hand and the force required to do this is only slight. Its sealing properties are good and a further advantage is that it also serves to close the drip catcher. However, its greatest advantage is that it can be manufactured as one-piece injection molding and is therefore so inexpensive that it can be considered even for throw-away bottles.

FIGS. 16 – 19 show additional possible embodiments of the closure according to the invention. Thus, for example, it is possible, as shown in FIG. 16, to construct the orifice rim of the outlet nozzle 110 of the base part as an elastically deformable sealing lip 71. The sleeve 116 of the closing member 101 is at the same time provided with a conical seating surface 72. In the closed position of the closing member 101, the sealing lip 71 is thus deformed and rests sealingly against the seating surface 72. When the closing member 101 is lifted off, the sealing lip 71 assumes the position shown in the right-hand part of FIG. 16. The plug 115 of the closing member 101 in this embodiment does not function as a seal but essentially only serves as a centering aid.

In the embodiment according to FIG. 17, the base part 102 is constructed as a dropper spout with a relatively wide air inlet tube 73 and a dropper orifice 74 outside the latter. Further, a conical seating surface 75 which also surrounds the dropper orifice 74 is provided. Instead of the collar part 103, the closing member 101 is not provided with a sleeve-shaped elastically deformable sealing lip 76 which, with the closing member 101 placed in position, rests sealingly against the seating surface 75. On the right-hand side of FIG. 17, the lip 76 is shown again, in the non-deformed condition. In this embodiment the plug 77 of the closing member 101 again only serves as a centering aid.

These embodiments of the bottle closure according to the invention are particularly suitable for the attachment of a tamperproof seal. As shown in FIGS. 18 and 19, the seal 80 is preferably fastened to the closing member 101 and/or to the base part 012 by means of a thin strap 81, in such a way that on opening the closure for the first time the seal is broken off after a slight resistance has been overcome.

That embodiment according to FIGS. 20 – 30 resembles that the FIGS. 11 – 14 but contains a childproof safety device in the lid 201, constructed as the closing member. This embodiment of the closure according to the invention comprises a collar 203 which is fastened on the container 200 so that it cannot be removed by children. It may, for example, be constructed integrally with the container 200. Further, the closure includes the actuating member 211 in the form of a tilting lever, which, in this embodiment, is manufactured as a separate part. As may be seen from FIGS. 22 and 23, the lid 201, in the closed position, rests with the sealing collar 216, projecting from its underside, in the conically chamfered inner wall 208 of the central orifice 210 in the collar 203, which is wedged onto the upper end of the container neck **200*a* by means of an inner bead 203*a* and an upper end-face ring-shaped part 203*b*, so that an outer annular bead 200*b* of the container neck is jammed between the inner bead 203*a* and the upper end of the collar 203**.

In the closed position, the sealing collar 216 sealingly rests, by its outer wall, against the conical inner wall 208 of the end-face ring-shaped part **203*b* of the collar 203 and as a result hermetically surrounds the outlet orifice 210 of the container 200. The seal is effected under the pressure exerted by the actuating member 211 which, in the closed position, exerts a force, via the support arm 205** serving as a connecting member, in the direction of the interior of the container.

In contrast to the special seal at the upper rim **10*a* of the dispensing orifice 10 of a bottle of which part is shown in FIG. 5, a seal can be more easily achieved in the present embodiment, in that the lid 201 which forms the closing member can, in this case, be injection-molded in one piece with the collar 203**, with precise matching of the dimensions. Hence, in this case it is not necessary to allow for the large deviations in dimensions which are encountered, for example, in the case of the mouth of glass bottles.

The lid 201 and collar 203 are joined to one another by a short, flexible hinge member 204.

The tilting lever 211 has two fork arms 206 and 207 which are hooked, by their lower free end, 206*a* and 207*a* respectively, each into an orifice 202*a* in the broadened base part 202 of the collar 203; their unhooking during tilting of the tilting lever 211 from the closed position to the open position or vice versa is made impossible as a result of appropriate design of the fork arm ends 206*a* and 207*a* and of the orifices 202*a*.

The support arm 205 is manufactured together with the tilting lever 211, preferably in one piece, by injection molding, and is flexibly joined to the tilting lever 211 via a hinge strap 215.

At its free end away from the hinge strap 215, which end is slightly displaced toward the front end 212 of the tilting lever, the support arm 205 is devised as a projecting joint head 205*a*, which is pressed into a correspondingly rounded, approximately semi-cylindrical joint socket 217, which is provided in the bottom of a recess 219 in the upper part of the lid 201. Between this joint socket 217 and the hinge member 204 the recess 219 in the lid has a further socket-like cavity 218, on which the underside of the support arm 205 comes to rest in the widest-open position of the lid 201, which prevents the joint head 205*a* from being drawn backwards out of the joint socket 217.

Three different possible means of closing the outlet orifice 210, on the underside of the lid 201, are shown firstly in FIGS. 22 and 23, secondly in FIG. 24 and finally in FIG. 26. FIGS. 22 and 23 show a conventional wide outlet orifice 210 in the mouth 200*a* of the neck of the container 200, the closing of which orifice by the lid 201 has already been described above in relation to the same figures.

In FIG. 24, the end wall 203*c* has, firstly, an inwardly-pointing venting nozzle 209, the air inlet orifice of which is sealed hermetically by a sealing collar 216*a* in the closed position, similarly to the seal effected by the sealing collar 216 in the case of the outlet orifice 210 (FIG. 22 and 23).

The end wall 203*c* further possesses, on the dispensing side, a relatively narrow outlet orifice 213 which, in the closed position, is hermetically sealed by a plug 214 which projects from the underside of the lid 201.

In the embodiment according to FIG. 26, the end wall 203*d* of the collar 203 is provided with a somewhat wider outlet orifice 213*a*, which in this case can again be sealed hermetically by a correspondingly wider plug 214*a* which projects from the underside of the lid 201.

The embodiment of the lever-actuated closure according to the invention shown in FIGS. 22 and 26 is provided with a child-proof safety device. This comprises, above all, a ball channel 220, serving as the main part of a ball race, in the lid 201, the race being completed by a window 221 in the support arm 205, which window forms a part of the race.

With the lid 1 closed, and the container 200 standing upright, a ball 222 sits in a nest 223 at the lowest point of the race 220.

In the simplest embodiment of the child-proof safety device, a further nest is provided in the window 221. If the container 200 is tilted forwards sufficiently, that is to say in the direction of the dispensing side, specifically until the window 221 is lower than the nest 223, the ball runs from the latter into the former. On the side on which the ball 222 runs out of the window 221, there is an upward ramp 224, and in the window on the outer wall of the part of the race there is, in the latter, an inner window projection 225, which is shifted somewhat off-center in the window 221, towards the entry side of the ball 222, whilst the edge of the inner wall of the race 220, on the entry side into the window 221, projects somewhat towards the dispensing side, and acts as a retaining edge 226. If now the support arm 205 is drawn backwards, that is to say in the direction of the hinge member 204, by actuating the tilting lever 211, the ball 222, which had rolled into the window 221 as a result of the container 200 having previously been tilted forwards, is jammed between the inner window nose 225, on the one hand, and the run-up ramp 224 and retaining edge 226 of the race 220 in the lid 201, on the other, and as a result the lid 201, together with the support arm 205, is drawn back by a small amount.

But a basic assumption is that the closure is sufficiently child-proof only if two conditions require to be fulfilled simultaneously in order to achieve opening. A single condition by itself could too easily be fulfilled accidentally, when playing with the bottle. Hence the following conditions are provided for:

The first condition which must be fulfilled is to tilt the tilting lever 211 a short way, up to a first stop, created by the interaction between noses 227 on the outer wall of the collar 203 and studs 228 and 229 on the inner wall of the fork arms 206 and 207 of the tilting lever 211.

As a second condition the container 200 must be tilted forward in the dipensing direction, whilst retaining the above position of the tilting lever. The degree to which the bottle is tilted forward depends on the depth of the nest 223 of the ball; the deeper is the nest 223, the further the container 200 has to be tilted forward, up to an approximatedly horizontal position.

The opening procedure can be complicated further by creating the tendency for the stud 228 to slide back onto the nose 227, as far as the fully closed position; in that case, the finger must be left on the tilting lever 211, whilst the second condition is fulfilled.

Opening can further be made difficult by moving the nest 223 from the position shown in solid lines in FIG. 25 to the position 223' shown in broken lines in FIG. 25. In that case, forward tilting of the bottle no longer suffices and instead the bottle must be turned so that the ball runs in the direction of the arrow, in the ball channel 220, through about three-quarters of a circle, until it reaches the engagement position E shown in solid lines (FIG. 25).

In the wall of the part of the lid 201 which is surrounded by the ball channel 220, which is opposite the side of that part of the lid, which carries the retaining edge 226 and is in contact with the support arm 205, and rests against the latter, there is provided a recess 231, extending essentially in an arc corresponding to the tilting movement of the tilting lever 211 and serving as a transverse channel 231, which recess, together with the window 221 of the support arm 205 and the abovementioned opposite contact side of this part of the lid, forms a guide channel for the ball 222 on opening the lid 201.

In the fully closed position of the tilting lever 211 and of the support arm 205, the ball 222 can now continue to roll, unhampered, through the window 221 of the support arm 205.

On slightly raising the tilting lever 211, however, the support arm 205 shifts so that its inner window nose 225 projects sufficiently far into the race 220 that the ball is trapped between the window nose 225 and the retaining edge 226 in the ball channel of the lid 201. On further tilting-open of the tilting lever 211, the support arm 205, together with the ball 222 held firmly therein, is tilted relative to the lid in the direction of the hinge 204 of the latter, whereupon the ball in the support arm 205 is raised slightly, by the retaining edge 226 on the one hand and a window nose 225, on the other, in the direction of the arrow (FIGS. 25 and 29), without being able to roll beyond the apex SP of the race 220, and at the same time the ball is slightly pushed to the side by the retaining edge 226, in the direction of the arrow in FIG. 25, and as a result is forced into the transverse channel 231.

On further tilting the tilting lever 211, and hence also the support arm 205, the spherical cap of ball 222 which now projects on one side from the support arm 205, slides in the transverse channel 231 in the direction of the lid hinge member 204, the transverse channel 231 executing a short arc about the pivot of the joint ball 205a in the lid 201.

As a consequence hereof, on continuing the tilting movement of the tilting lever 211, the support arm 205 is raised with the ball 222 present therein, and the lid 201 is tilted about its hinge member 204 until the lid 201 has been raised into the position shown in FIG. 26.

Whilst the ball is shifting in the said guide channel 231, the support arm and lid, of course, remain locked together since the guide channel is only sufficiently deep to admit the aforesaid spherical cap of the ball, whilst the rest of the ball must remain in the window of the support arm.

Only when, as a result of having moved the tilting lever fully back into the closed position as shown in FIG. 25, the inner window nose 225 in the window 221 has moved sufficiently far away from the retaining edge 226, the ball 222 can roll out, in the direction of the arrow, in the channel 220, until it reaches the nest 223 or 223'.

The opening movement of the lid is limited by the support arm 205 abutting against the front edge at the end 212 of the tilting lever 211. If the tilting lever 211 is tilted back without the ball 222 having been caught in the support arm, the stud 228 on the inside of the tilting lever runs up against a lid stud 230, present on the outer wall of the lid, thereby, the shifting movement of the tilting lever 211 is limited, the lid 201 remaining in closed position.

On proper opening, during which the ball 222, acting as a connecting member in the transverse channel 231 of the lid 201, carries the latter with it (FIG. 30 (*b*)), the resulting lifting of the lid 201 also lifts the stud 230 on the lid to the point that the stud 228 on the inside of the tilting lever 211 slides past under the stud 230 on the lid (FIG. 30 (*a*)).

The attachment of the nose 227 on the outside of the collar 203, and the attachment of the stud 230 on the lid, is illustrated in FIGS. 25 and 27 and the arrangement of the studs 228 and 229 on the inside of the fork arms 206 and 207 is illustrated in FIGS. 25 and 28.

Finally, FIG. 30 illustrates how the stud 228 slides past the adjacent stud 230 on the lid in position (*c*), whilst the studs engage in position (*b*). Position (*a*) shows the position of the studs 228 or 229 (FIG. 25) and 230 on complete closing of the lid 201.

I claim:

1. A lever-actuated closure, for bottles or the like containers, comprising a collar or base part adapted for being fixed to the rim of an orifice of the container which is to be closed, a closing member one side of which is hingedly connected to said collar, an actuating member having a manually operated gripper part and being hingedly mounted on said collar below the outlet orifice, and a connecting member hingedly attached to the actuating member and to the closing member at the outside thereof, which closure can be transferred, by means of the actuating member, from an open position, in which the closing member frees the outlet orifice, through elastic deformation of at least one of the said parts of the closure, via a dead-center position, in which the hinge axis of the actuating member and the two hinge axes of the connecting member are in a common plane, into a closed position, in which the closing member seals the outlet orifice, or vice versa from this closed position into the open position, the gripper part of the actuating member being, in the closed position, above the elastically deformed closing member and being movable sideways and downwards, relative to the closing member for opening the closure.

2. A closure as defined in claim 1, wherein the connecting member in its dead-center position, is above the outlet orifice, said collar having a through-passage registering with the outlet orifice in said container, the outlet mouth of which forms the outlet orifice destined to be closed by the closing member.

3. A closure as defined in claim 2, wherein the base part has a bearing in which the closing member is mounted hingedly so that it can be tilted away from and toward the outlet orifice.

4. A closure as defined in claim 3, wherein the site of engagement (12, 215) of the connecting member on the actuating member, in the closed position, is further away from the bearing of the closing member on the base part than in the said dead-center position and can, on opening, be moved through the latter position in the direction of the said bearing.

5. A closure as defined in claim 4, wherein the actuating member is constructed as a tilting lever, the middle part of which has a fork-like or stirrup-like extension by means of which it is rotatably mounted on either side of the base part; there being located, on one end of the tilting lever, the engagement site of the connecting member with the tilting lever and an abutment for resting against the outer surface of the closing member in the closed position, whereby, on pressing the opposite, free end of the tilting lever, the latter is tilted outwards and downwards relative to the outlet orifice in the base part, and whereby, at the same time, the connecting member, via its engagement site on the closing member lifts the latter off the outlet orifice in the base part whilst pivoting the closing member about its bearing on the base part.

6. A closure as defined in claim 5, wherein the side wall of the connecting member acts as an abutment which, in the closed position, extends between the engagement site of the connecting member on the tilting lever and the bearing of the connecting member on the closing member in the direction of the outlet side, the said side wall coming to rest against the outer surface of the closing member.

7. A closure as defined in claim 6, wherein the side wall of the closing member which is located between the engagement site of the connecting member with the actuating member and the bearing on the closing member, in the direction of the hinge member, comes to rest, in the open position, against a part of the outer surface of the closing member located in the direction of the hinge member.

8. A closure as defined in claim 6, wherein the outer surface of the closing member has a recess, in the center of the bottom of which is provided the bearing for the connecting member, and wherein the side wall of the recess, on the discharge side, serves as a stop for one side wall of the connecting member in the closed position, whilst the opposite side wall of this recess, namely the side wall on the side of the hinge member, serves as a stop for the other side wall of the connecting member on opening the closure.

9. A closure as defined in claim 2, wherein the base part, the actuating member and the connecting member consist of synthetic thermoplastic material, and are integral with one another, and wherein the closure further comprises hinges which connect the base part to the actuating member and the latter to the connecting member and which are constituted by flexible straps which join these parts.

10. A closure as defined in claim 9, wherein the closing member consists of synthetic thermoplastic material and is integrally joined to the base part via a flexible strap serving as a hinge.

11. A closure as defined in claim 1, wherein the actuating member consists of a substantially U-shaped stirrup, of which the two arms are hinged onto the collar whilst its central strap is constructed as a gripper part and has the connecting member hinged onto it.

12. A closure as defined in claim 11, wherein the connecting member comprises two fork arms which are resiliently separated in the direction of the hinge axis of said connecting member with said closing member, said fork arms having bearing pegs at their ends and extending in the direction of the hinge axis, said bearing pegs being resiliently engaged in correspondingly shaped undercuts of the closing member, each of said undercuts forming a hinge bearing.

13. A closure as defined in claim 12, wherein the collar comprises at least one stop for the actuating member, which stop limits the movement of the latter in the closing direction shortly after having passed the dead-center position.

14. A closure as defined in claim 13, wherein the collar and the actuating member comprise mutually cooperating releasable engagement means comprising sliding studs which hold the actuating member in the open position.

15. A closure as defined in claim 1, further comprising a child-proof safety device consisting of a coupling element housed in the lid and, during opening movement, in the support arm, wherein the connecting member can only take the lid with it during movement of the tilting member when the coupling element provides a positive connection between the lid and the support arm.

16. A closure support defined in claim 15, wherein the coupling element is a ball and wherein the child-proof safety device further comprises a ball race, consisting of a ball channel running through the lid, and extending from one side wall of the support arm to the opposite side wall thereof, and a window in the suppot arm, which window completes the ball race, and holding means in and near the window, by means of which the ball can be held in the window of the support arm in a position which locks the support arm and the lid to one another.

17. A closure as defined in claim 16, wherein the ball channel and the window are so arranged relative to one another that, when the closure is tilted forwards over the outlet orifice, the ball runs into the locking position.

18. A closure as defined in claim 17, wherein said actuating member is constructed as a tilting lever, having two fork arms which are hinged onto opposite sides of the lid in the region between the hinge member and the outlet orifice of the collar, on the base part of the latter, and wherein said fork arms comprise studs pointing in the direction of the adjacent lid wall and projecting each from the inside of one of the fork arms.

19. A closure as defined in claim 18, wherein the lid comprises, on each side thereof, in the direction toward the hinge member, lid studs projecting in the direction toward the inner walls of said fork arms where the latter surround the stud-bearing part of the lid, and wherein said lid studs are contacted by said fork-arm studs when the lid and the support arm are not coupled to one another by the ball, whilst when the lid and support arm are coupled by means of the ball, the lid is lifted so much that on moving the tilting lever back further, the fork-arm studs on the latter can slide past under the lid studs.

20. A closure as defined in claim 19, wherein said holding means comprise a run-up ramp the distance of which from the window is less than the diameter of the ball, a nose provided in the wall of the window on the outlet orifice side, and projecting into the window, and a retaining edge projecting beyond the inner side wall of the window, in the direction of the said window, and resting against the support arm, the said retaining edge being in the part of the lid which forms the inner wall of the ball channel.

21. A closure as defined in claim 20, wherein said lid comprises, on the parts of the wall thereof, which face the insides of the fork arms, lid studs, against which the tilting lever runs up after a short initial movement in the direction of the open position, and as a result lifts the support arm somewhat, and at the same time moves the window nose in the window in such a way that it holds the ball, which as a result of the tilting of the closure into a locked position has rolled into the window.

22. A closure as defined in claim 21, wherein said lid comprises a recess in the wall of that part of the lid which, firstly, is surrounded by the ball race, secondly is opposite that side of the last-mentioned part of the lid which carries the retaining edge, and, thirdly, is in contact with the support arm and rests against the latter; said recess essentially extending over an arc corresponding to the tilting movement of the tilting lever, and said recess, together with the window of the support arm and the abovementioned opposite contact side of this part of the lid, forming a guide channel for the ball during opening movement of the lid.

* * * * *